US005595204A

United States Patent [19]

Hwang

[11] Patent Number: 5,595,204

[45] Date of Patent: Jan. 21, 1997

[54] MULTI-USE COLLAPSIBLE SUN-SHADE TENT

[76] Inventor: Chyi-Ming Hwang, P.O. Box 90, Tainan City, 704, Taiwan

[21] Appl. No.: 632,615

[22] Filed: Apr. 15, 1996

[51] Int. Cl.[6] ..... E04H 15/42

[52] U.S. Cl. ..... 135/142; 135/88.11; 135/156; 135/901

[58] Field of Search ..... 135/139, 140, 135/141, 142, 143, 151, 153, 156, 157, 115, 88.01, 88.11, 900, 901, 902

[56] References Cited

U.S. PATENT DOCUMENTS

| | | | |
|---|---|---|---|
| 2,886,047 | 5/1959 | Healy | 135/139 X |
| 4,702,478 | 10/1987 | Kruse | 135/157 X |
| 4,997,021 | 3/1991 | Brutsaert | 135/88.11 X |
| 5,167,246 | 12/1992 | Mortenson | 135/153 |
| 5,197,503 | 3/1993 | Chen | 135/151 X |
| 5,458,079 | 10/1995 | Matthews et al. | 135/901 X |

FOREIGN PATENT DOCUMENTS

| | | | |
|---|---|---|---|
| 0609426 | 5/1988 | Australia | 135/88.11 |
| 3610635 | 10/1986 | Germany | 135/88.11 |

*Primary Examiner*—Lanna Mai

[57] ABSTRACT

A multi-use collapsible sun-shade tent consists of a pair of lateral beams and two pairs of lengthwise beams, and four vertical posts and a sun-shade cloth, collapsibly combined together by means of connecters at four corners where the lateral beams and the lengthwise beams meet and at an intermediate portion where two half portions of each lateral beam are connected with each other. The four posts support the four corners where the lateral beams and the lengthwise beams meet and are structured able to be adjusted in height. The sun-shade cloth is held between the two lateral beams and possible to be wound around one collapsed half lateral beam.

3 Claims, 11 Drawing Sheets

MULTI-USE COLLAPSIBLE SUN-SHADE TENT

BACKGROUND OF THE INVENTION

This invention concerns a multi-use collapsible sun-shade tent, particularly possible to be collapsed into two half length of one lateral beam, and thereby possible to be carried on a small car to any location.

A common traditional sun-shade tent is used for shielding a station wagon, having a length longer than that of the station wagon and a height higher than that of the wagon and fixed on an upper edge of a lengthwise side thereof and collapsibly spread out for shielding the wagon.

However, this traditional common sun-shade tent is only suitable for a considerably long station wagon, and can break a little the structure of a station wagon itself, and disfigure its whole appearance in some degree. Then the sun-shade cloth is always exposed to the sunlight, maybe short-lived thereby. Besides, it can not be carried to a location where a station wagon cannot reach.

SUMMARY OF THE INVENTION

The purpose of this invention is to offer a kind of multi-use collapsible sun-shade tent, able to be carried on a small car.

A main feature of this invention consists in two lateral beams respectively made of two half portions connected foldably with each other for collapsing and spread to be secured straight by means of a locking means in use. Two pairs of lengthwise extensible beams are provided to be combined with the two lateral beams by means of connecters fitted in a lengthwise groove opening downward and a lengthwise groove opening sidewise of each lateral beam and having an empty chamber opening sidewise, in which the two ends of each lengthwise beam engage. Then four vertical extensible posts are provided to respectively support each connecter of four corners where the two lateral beams and the two lengthwise extensible beams meet. A sun-shade cloth is held between the two lateral beams and possible to be folded in half length after each lateral beam is folded in half length, and can be wound around on one collapsed half lateral beam.

BRIEF DESCRIPTION OF DRAWINGS

This invention will be better understood by reference to the accompanying drawings, wherein.

DESCRIPTION OF THE PREFERRED EMBODIMENT

Figure 1:
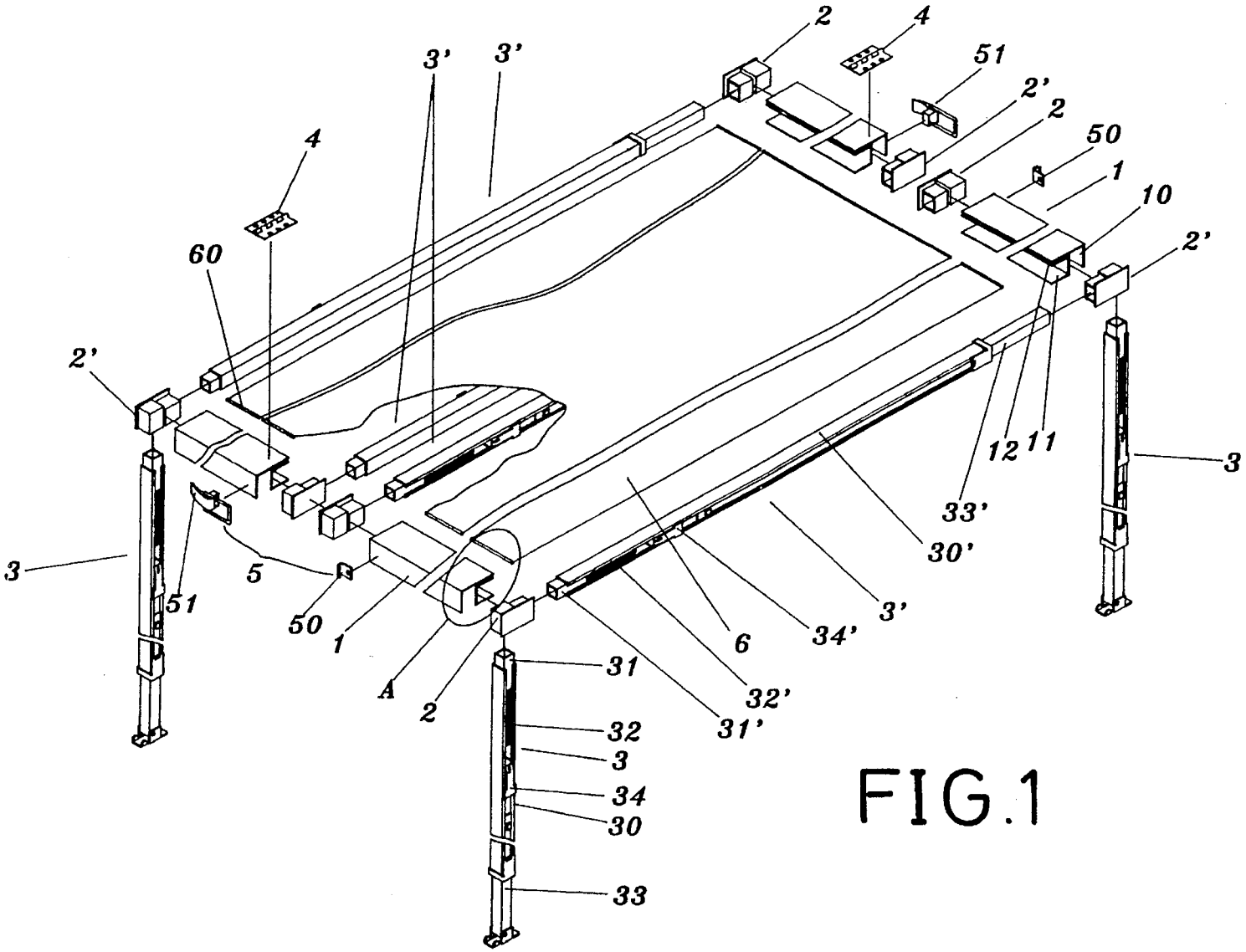
FIG. 1 is an exploded perspective view of a multi-use collapsible sun-shade tent in the present invention.
Figure 2:
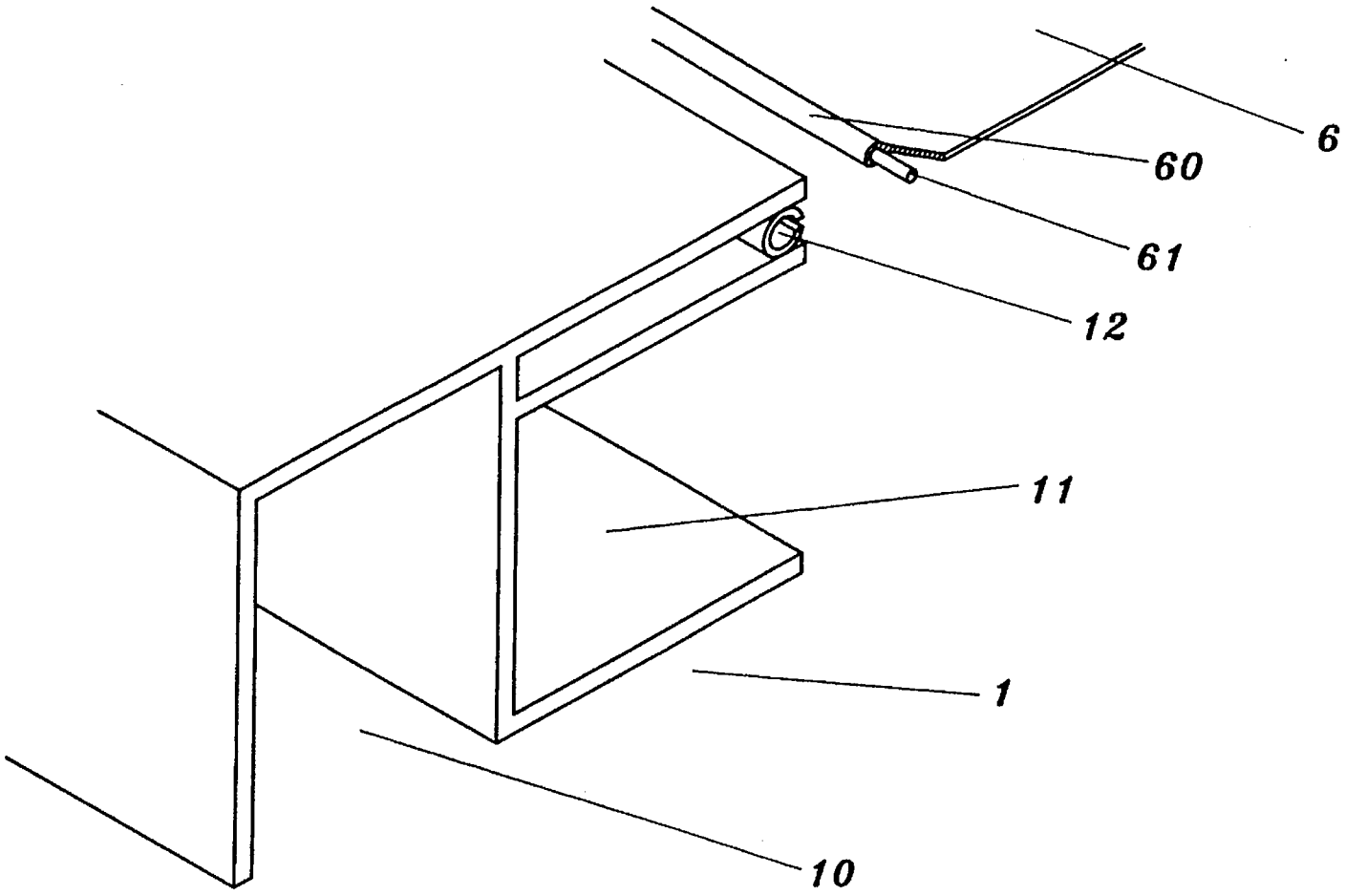
FIG. 2 is a magnified perspective view of the part marked A in FIG. 1.
Figure 3:
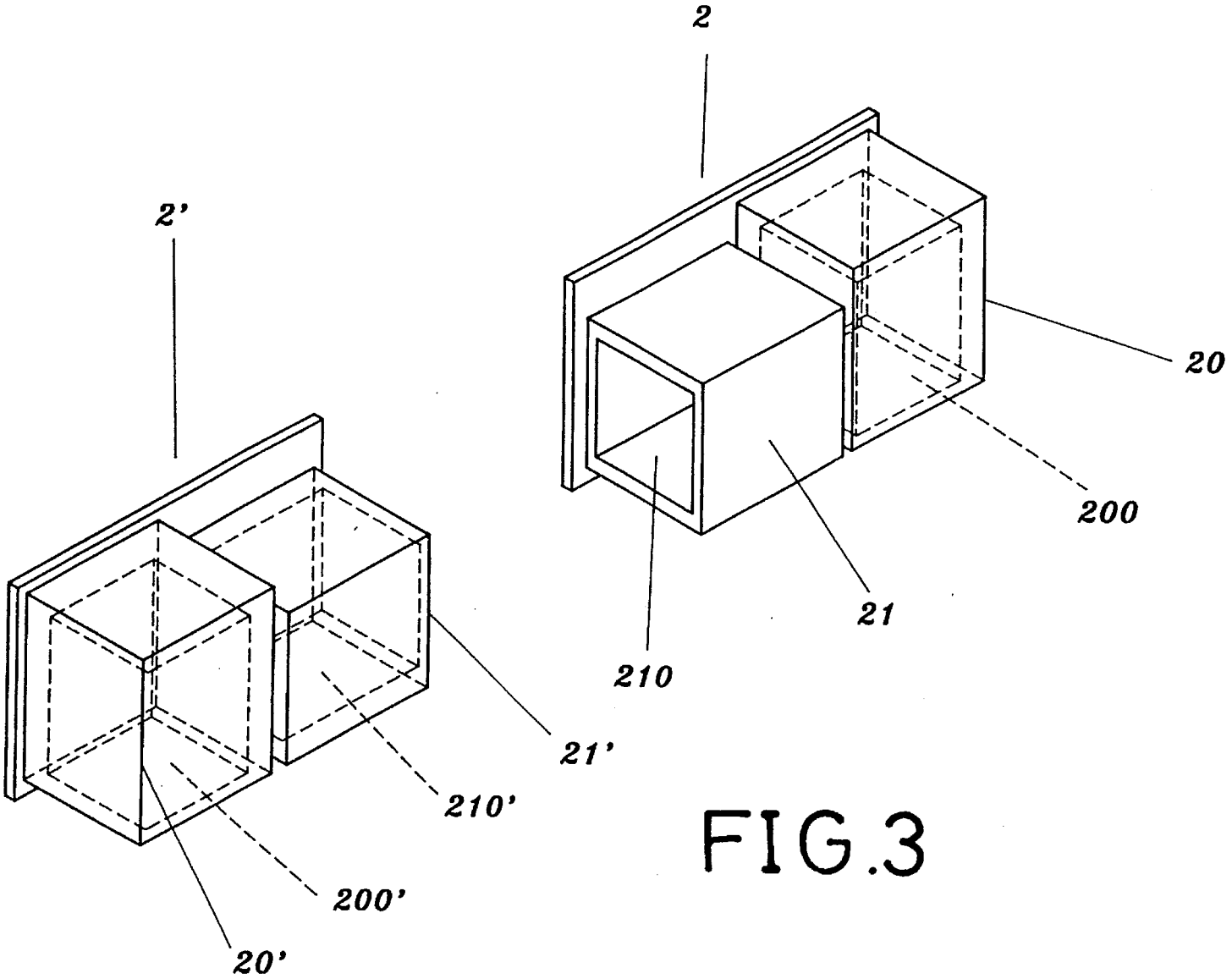
FIG. 3 is a magnified perspective view of block connecters in/the multi-use collapsible sun-shade tent in the present invention.

A preferred embodiment of a collapsible sun-shade tent in the present invention, as shown in FIGS. 1 and 2, includes two lateral beams 1, 1, four lengthwise extensible beams 3', a plurality of block connecters 2, 2', four extensible posts 3, two hinges 4 respectively connecting two half portions of each lateral beam 1, two locking means 5 respectively holding straight each lateral beam 1, and a sun-shade cloth 6 as main components assembled together.

The two lateral beams 1, 1 are respectively located at a right side and a left side and between upper ends of two pairs of extensible posts 3, having a lengthwise groove 10 opening downward and a lengthwise groove 11 opening sidewise and a lengthwise narrow groove 12 opening sidewise and located directly on the groove 11.

The four lengthwise extensible beams 3' are respectively located parallel between the two lateral beams 1, 1 at a front side, a rear side and at an intermediate portion the beams 1, 1 and between upper ends of two pairs of the extensible posts 3 and between block connecters 2, 2' connecting each lateral beam 1 with each lengthwise extensible beam 3' with two ends inserting in empty chambers 210, 210' of the block connecters 2, 2'. Each lengthwise extensible rod 3' has an outer rod 30', an inner block 31' inserted in a left end of the outer rod 30', a spring 32' inserted in the outer rod 30' and under the inner block 31', an extension rod 33' inserted in the outer rod 30' under the spring 32' and extending out of a left end of the outer rod 30', and a position means 34' fixed on an upper end of the extension rod 33' so that the extension rod 33' may be adjusted in its position to change the whole length of each extensible beam 3'.

Each block connecters 2, 2' is arranged diagonally located both at each of four corners where each lateral beam 1 meets with each lengthwise extensible beam 3' and on the upper ends of the four posts 3 and at two block connecters 2 between two half portions of each lateral beams 1, having two engage blocks 20, 21, 20', 21', which form empty chambers 200, 210, 200', 210' opening in the same direction as the grooves 10 and 11 of the lateral beams 1.

The four extensible posts 3 support the block connecters 2, 2' fitting with two ends of each lateral beam 1, with their upper ends inserted in the empty chambers 200,200' of the block connecters 2, 2'. Each extensible post 3 is structured the same as the extensible beam 3', having an outer rod 30, in inner block 31 fitting in an upper end of the outer rod 30 and also in the empty chambers 200, 200' of the block connecters 2, 2'. A spring 32 fitted in the outer rod 30 under the inner block 31, and an extension rod 33 fitted in the outer rod 30 under the spring 32 and having a position hook 34 at an upper end. So each extensible post may be adjusted in height by means of the extension rod 33 and the position hook 34.

The two hinges 4 are respectively set on an upper surface of each lateral beam 1 so that each lateral beam 1 consisting of two half portions may be folded in a half length.

The two locking means 5 are respectively fixed on an outer vertical side of each lateral beam 1 so that the two half portions of each lateral beam 1 may be held held straight when this tent is in use. Each locking means 5 consists of a hook 50 and a hook stop 51 engaging or disengaging from the hook 50.

The sun-shade cloth 6 is to be stretched between the two lateral beams 1 positioned in the narrow grooves 12 of the two lateral beam 1, having its two ends 60, 60 hooked in a tubular supporter 61 set in an an opening of each narrow groove 12.

Figure 4:
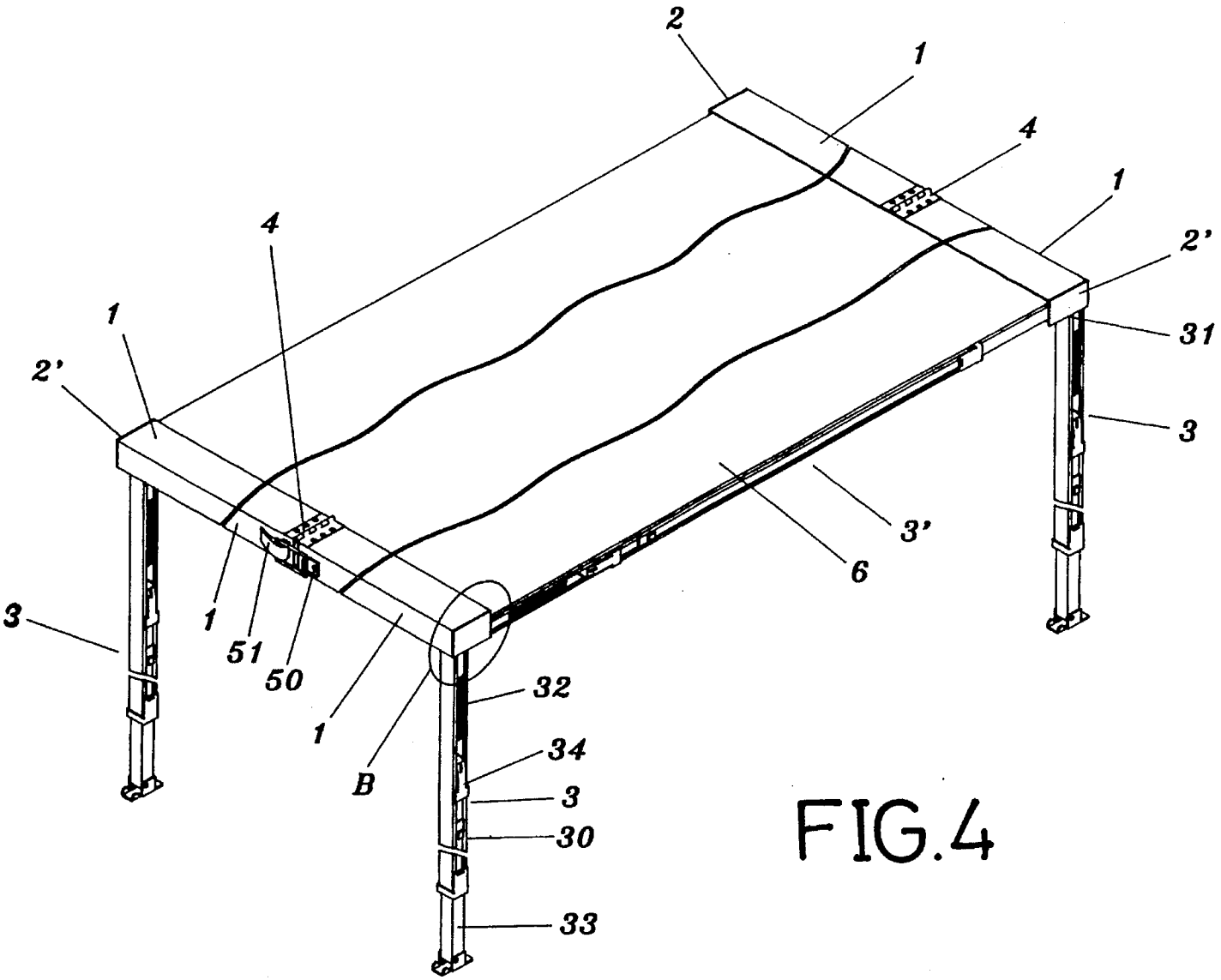
FIG. 4 is a perspective view of the multi-use collapsible sun-shade tent in the present invention.
Figure 5:
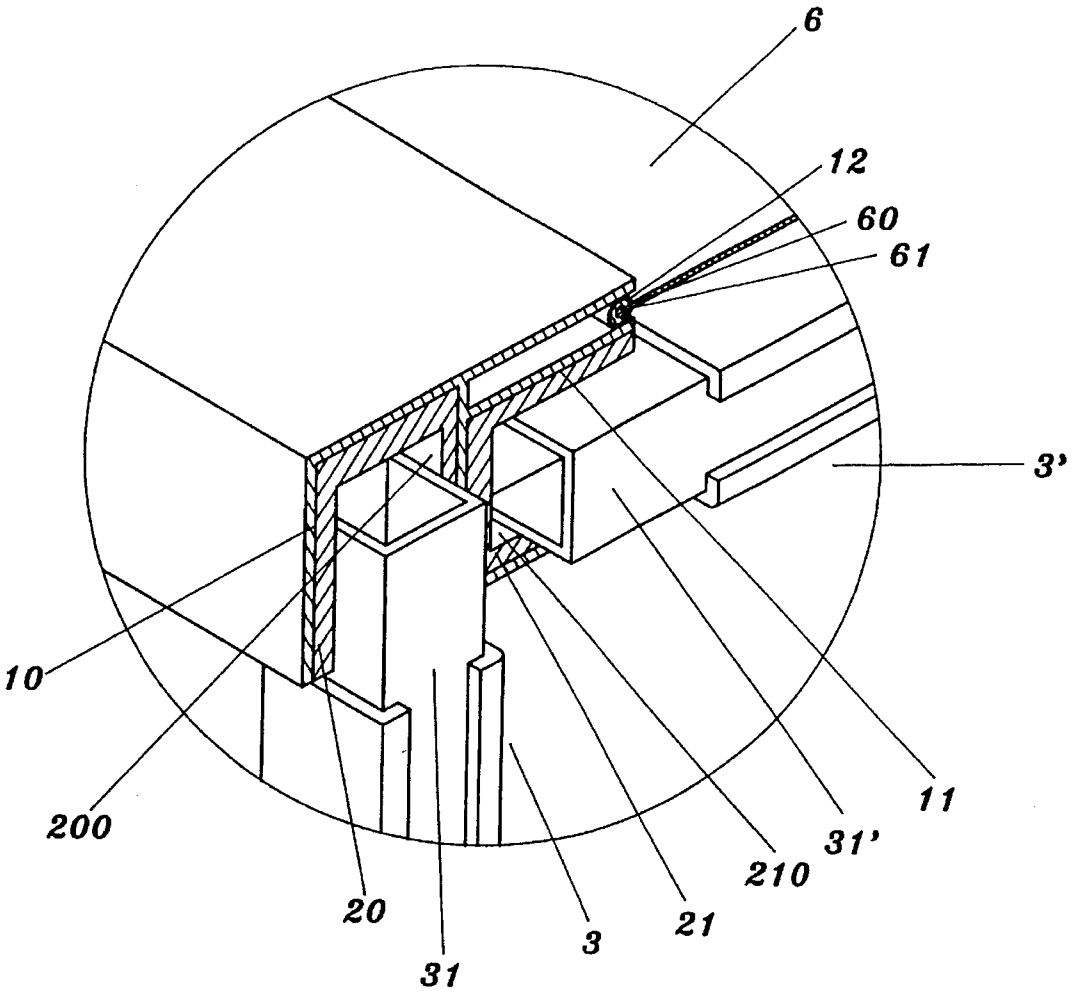
FIG. 5 is cross-sectional view of the part marked B in FIG. 4.

In assembling, referring to FIGS. 4 and 5 firstly, the sun-shade cloth 6 is forced to let its two ends 60, 60 slide into the tubular supporters 61, 61 from one side of the narrow grooves 12. Then the sun-shade cloth 6 is positioned securely between the two lateral beams 1, 1, held tight by the tubular supporters 61, 61. Next, the block connecters 2, 2' are combined securely with the lateral beams 1, 1, with the engage blocks 20, 21, 20', 21' respectively fitted in the grooves 10 11 of the lateral beams 1. Then the hinges 4 are combined with two half portions of each lateral beam 1, enabling each lateral beam 1 be folded. Then the hook 50 of the locking means 51 is fixed on one half portion of each lateral beam 1 and the hook stop 51 is fixed on the other half portion, with the hook 50 and the hook stop 51 being positioned in a straight line and hooked with each other to hold the two half portions of each lateral beam 1 secured in a straight line. Next, the left end of each lengthwise extensible beam 3' is combined with the block connecter 2, with the inner block 31' engaging the empty chamber 200 of each connecter 2, and the right end of the beam 3' engaging the empty chamber 200' of each connecter 2'. Then, the inner block 31 of each extensible post 3 is vertically inserted in the empty chambers 210 or 210' of each block connecters 2, 2' with the extension rod 33 adjusted and locked at one of plural positions by the position means 34, finishing assemblage of the multi-use collapsible sun-shade tent.

Figure 6:
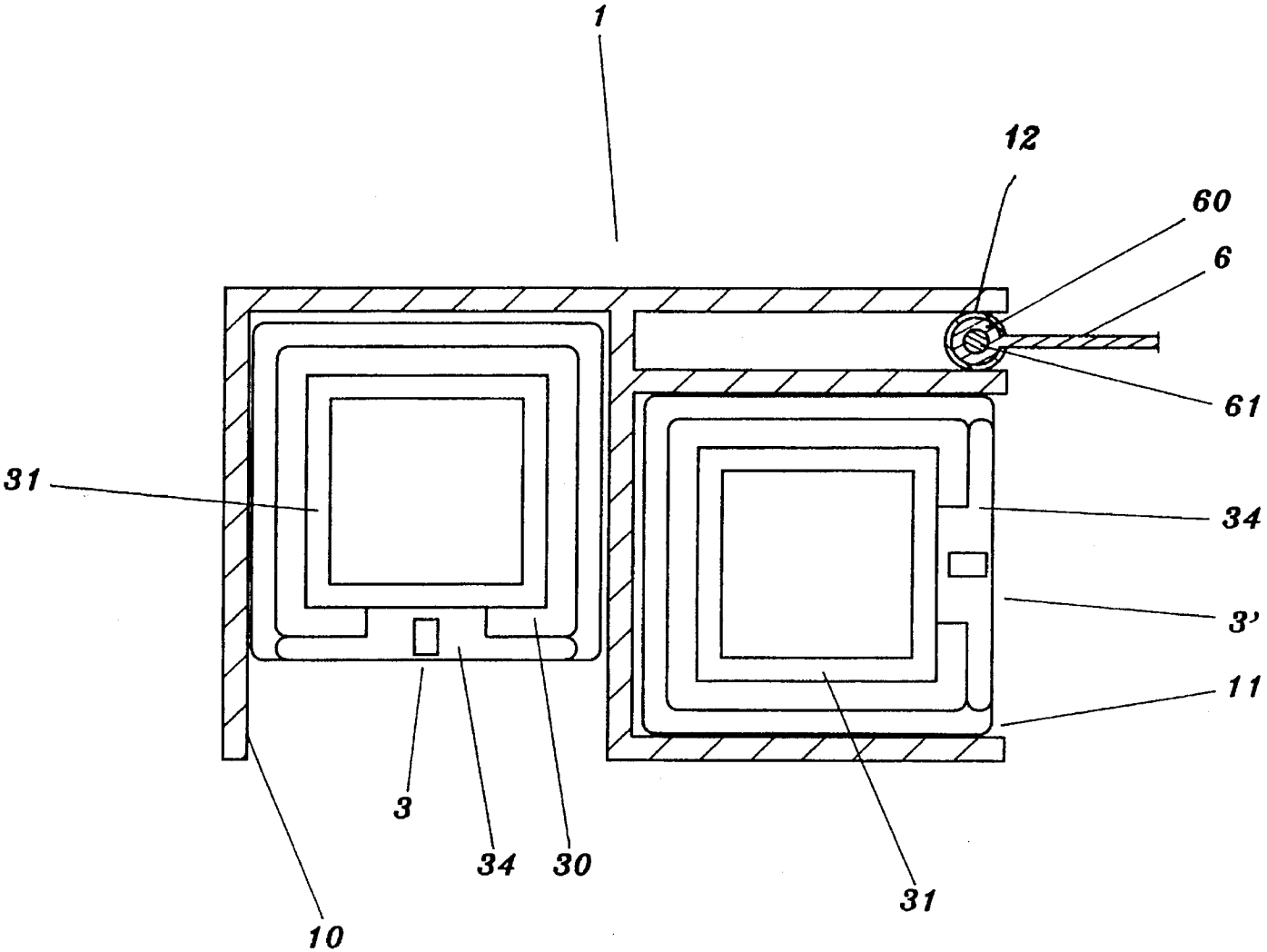
FIG. 6 is a cross-sectional view of an extensible vertical post and an extensible lengthwise beam stored in a lateral beam in the multi-use collapsible sun-shade tent in the present invention.
Figure 7:
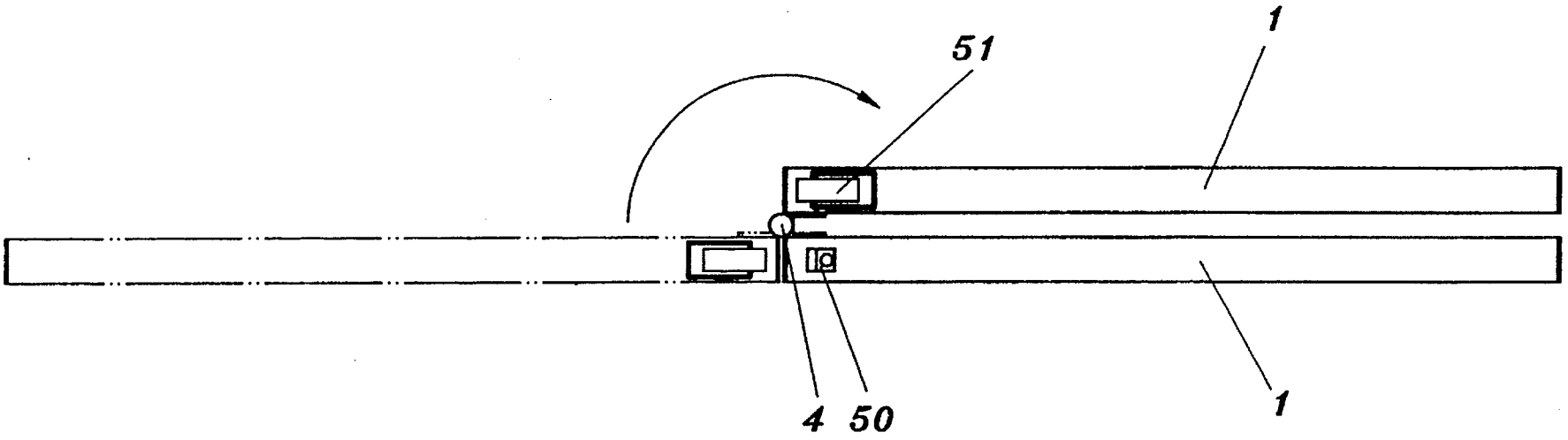
FIG. 7 is a side view of the lateral beam of the multi-use collapsible sun-shade tent in the present invention, showing how the lateral beam is folded in half.
Figure 8:
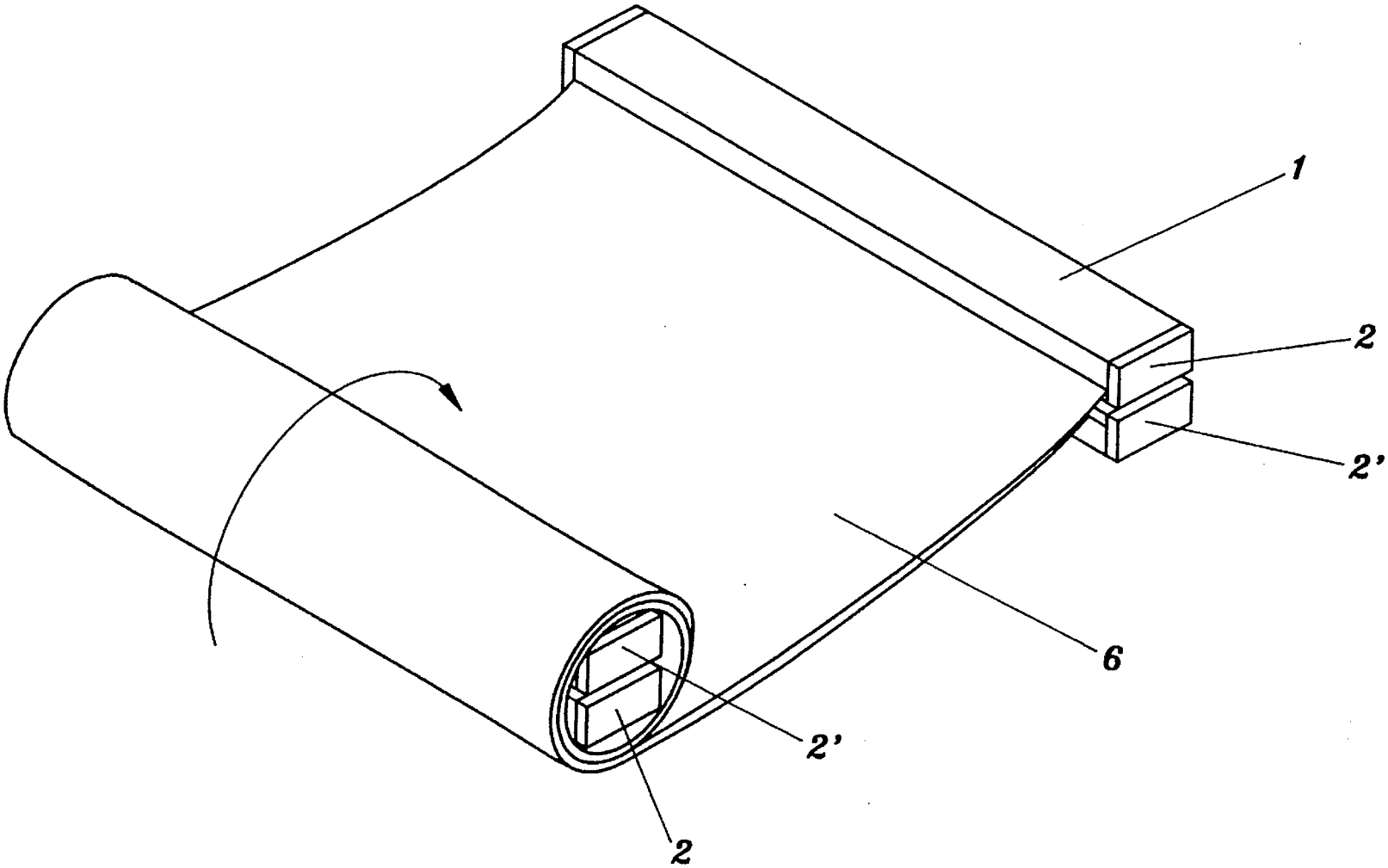
FIG. 8 is a perspective view of a sun-shade of the multi-use collapsible sun-shade tent in the present invention, showing how the sun-shade is folded in half and wound around on one half portion of the lateral beam folded.
Figure 9:
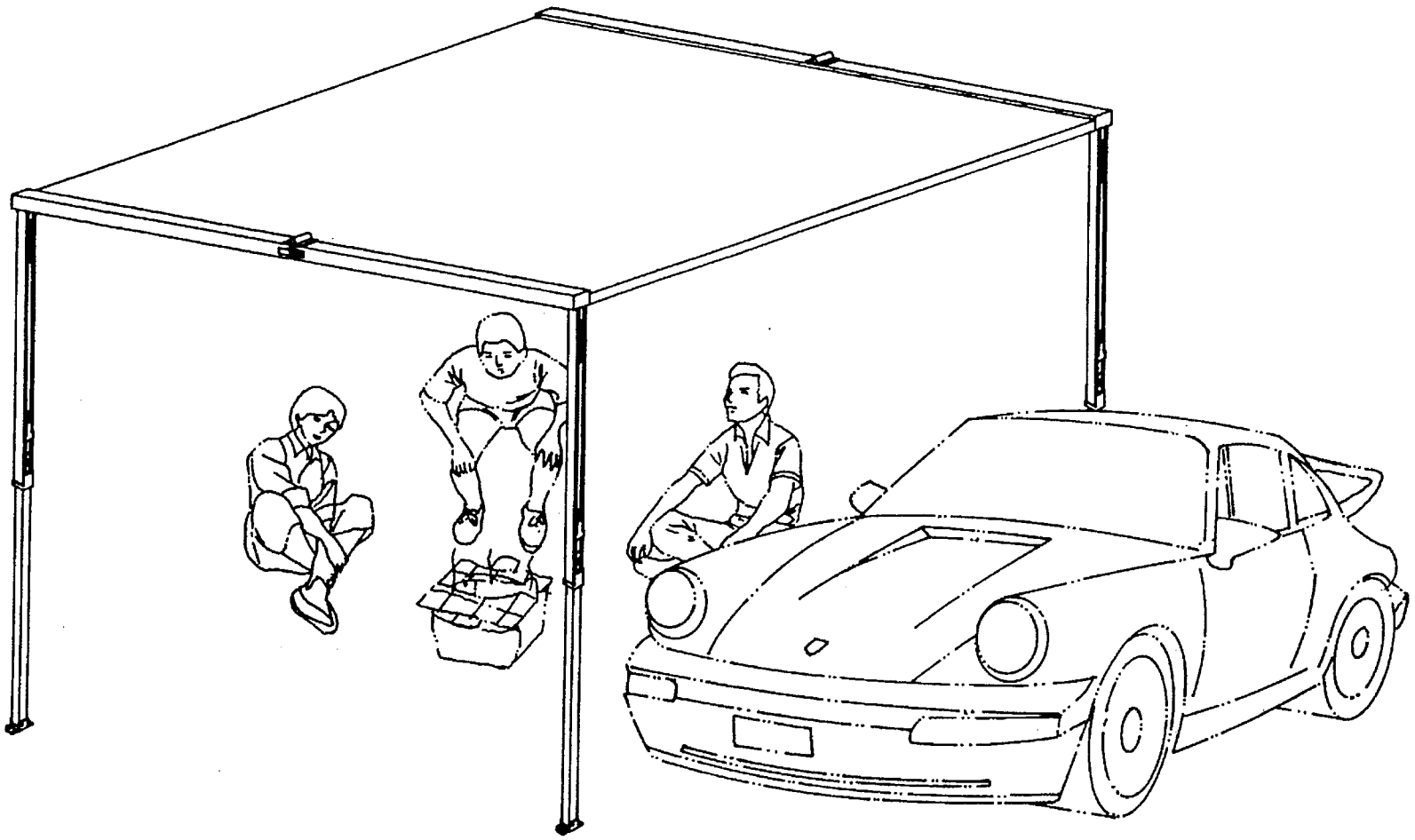
FIG. 9 is a perspective view of the multi-use collapsible sun-shade tent in the present invention, showing it being used in one way.
Figure 10:
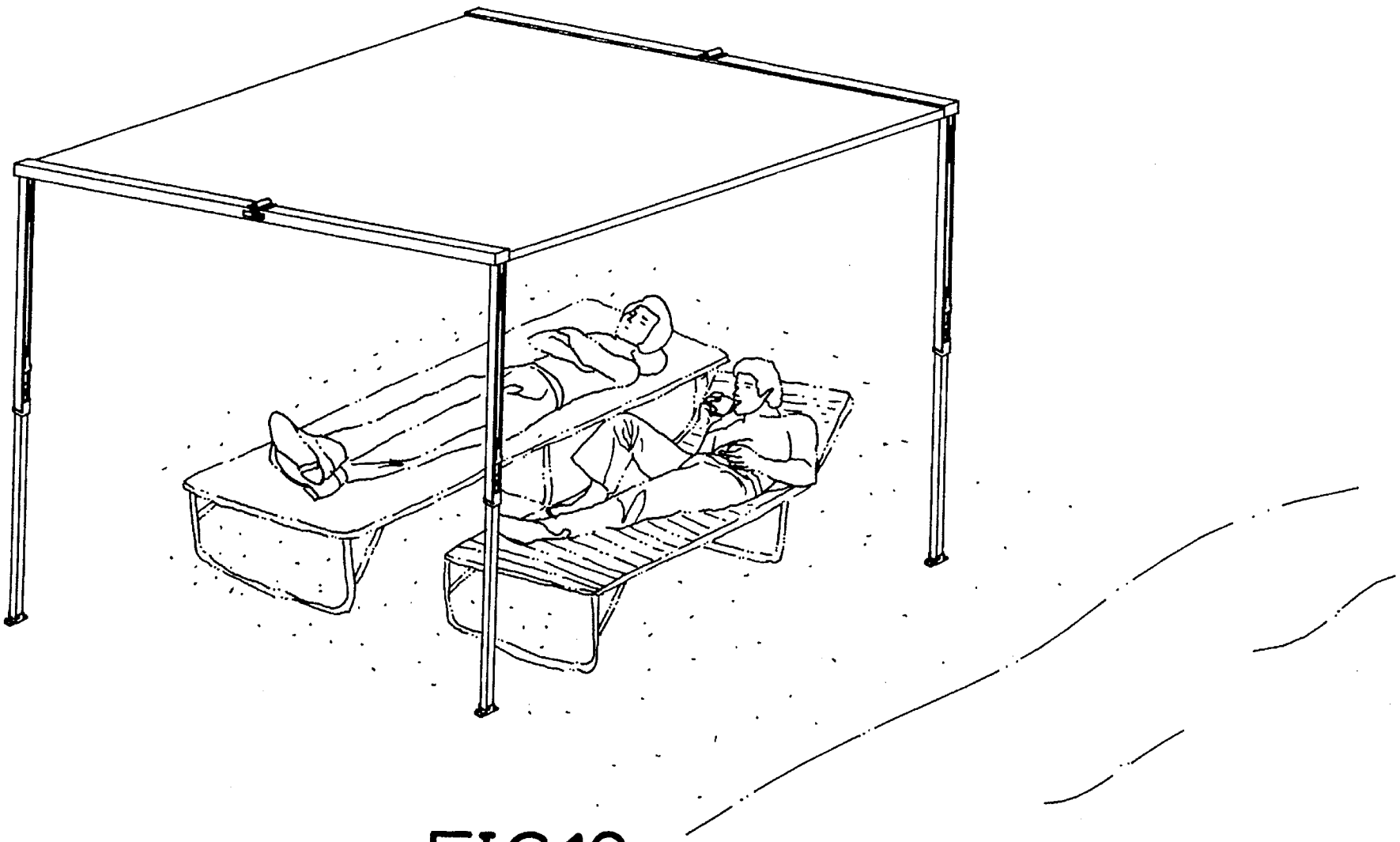
FIG. 10 is a perspective view of the multi-use collapsible sun-shade tent in the present invention, showing it being used in another way; and, FIG. 11 is a perspective view of the multi-use collapsible sun-shade tent in the present invention, showing it being used in another way.
Figure 11:
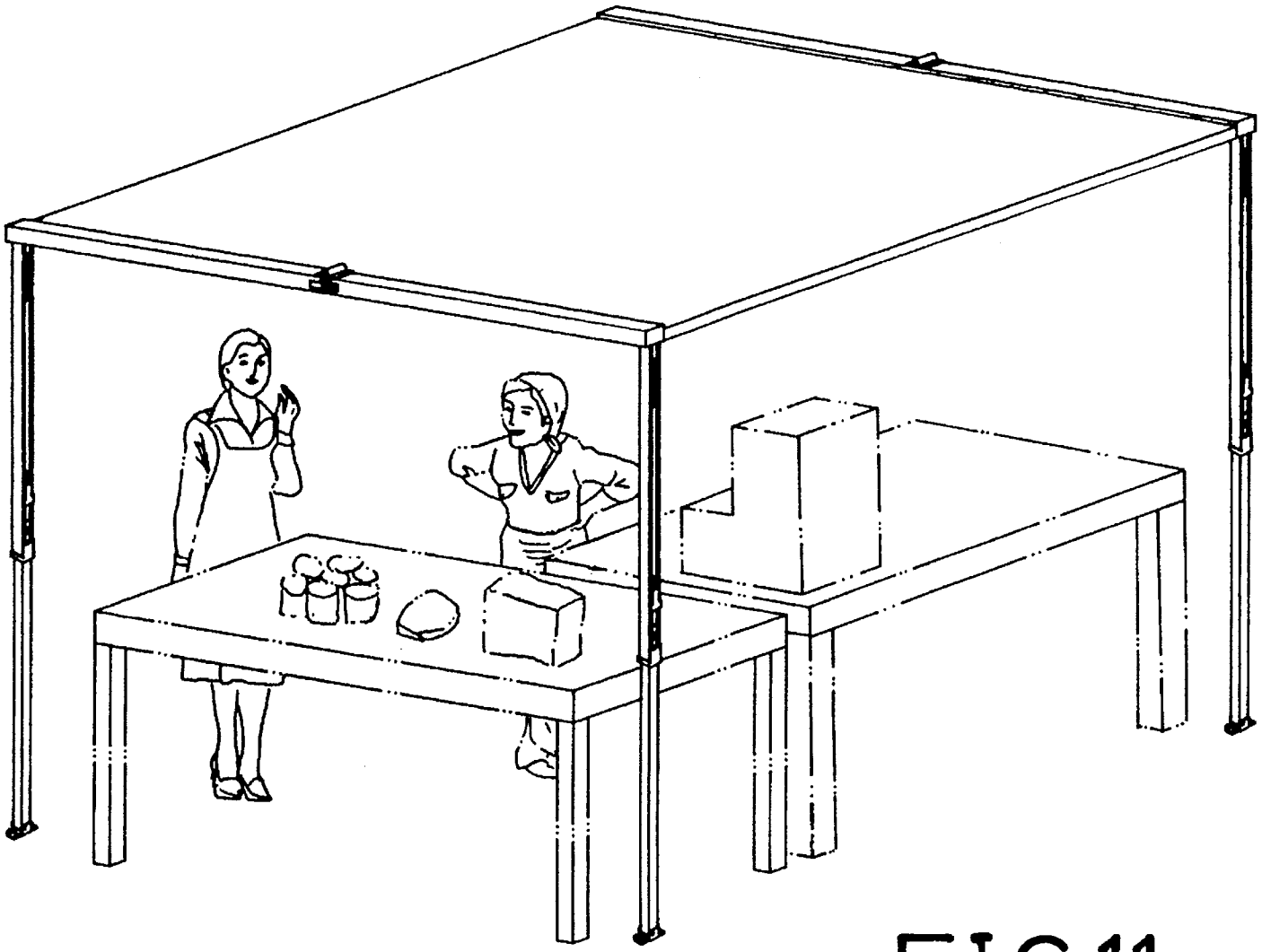

In collapsing the sun-shade tent in spread condition, firstly, the four posts 3 are separated from the block connecters 2, 2', and then placed in the lengthwise grooves 10 of the lateral beams 1. Next, the lengthwise beams 3' are separated from the block connecters 2, 2' and then placed in the lengthwise grooves 11 of the lateral beams 1, as shown in FIG. 6, with the extension rods 33 engaging with the block connecters 2, 2' located at two ends of the lateral beams 1. Then the locking means 5 is unhooked, permitting the two half portions of each beam 1 connected with the hinges 4 folded in half, as shown in FIG. 7. Meanwhile, the sunshade cloth 6 is also folded into half width together with the lateral beams 1, 1, and then can be wound around one of the half-folded beam 1, as shown in FIG. 8, to move near the other half-folded lateral beam 1. Then the collapsed sun-shade tent can be carried by a small car to be used in a picnic on a-sea shore or in a wood, or in a garden party.

This invention has the following advantages, as understood from the above description.

1. It can be carried on a small car, in the collapsed form.

2. It can be moved to any location for use.

While the preferred embodiment of the invention has been described above, it will be recognized and understood that various modifications may be made therein and the appended claims are intended to cover all such modifications which may fall within the spirit and scope of the invention.

What is claimed is:

1. A multi-use collapsible sun-shade tent comprising:

a pair of lateral beams located in two opposite horizontal sides, having one lengthwise groove opening downward and another lengthwise groove opening sidewise, and a narrow lengthwise groove on said lengthwise groove opening sidewise, each said lateral beam consisting of two half portions;

two pairs of lengthwise beams, said one pair located in two opposite horizontal sides between said pair of lateral beams, and another pair between an intermediate portion of each of said two lateral beams;

a plurality of connecters located diagonally and fixed in said lengthwise groove opening sidewise of each said lateral beam, respectively having two empty chambers, one of said chambers opening downward and the other opening sidewise;

four vertical extensible posts having their upper ends respectively fitted in said downward empty chambers of said connecters;

two hinges connecting said two half portions of each said lateral beams so as to let one half portion folded on the other half portion in collapsing said tent;

two locking means fixed on a vertical side of each said lateral beam to hold each said lateral beam in a straight line;

a sun-shaped cloth having its two ends respectively secured in each said narrow groove of each said lateral beam; and said vertical posts being able to be directly separated from said connecters in collapsing and to be stored in said lengthwise grooves opening sidewise of said lateral beams, said lengthwise beams being able to be separated from said connecters and to be stored in said lengthwise grooves opening downward of said lateral beams, said locking means being unhooked so as to fold said two half portions of each said lateral beam in half length, said sun-shaped cloth being able to be wound around said collapsed half lateral beam so as to be easily carried on a small car or the like.

2. The multi-use collapsible sun-shade tent as claimed in claim 1, wherein said posts respectively comprises an outer rod, an inner block and a spring under said inner block being fitted in said outer rod, and an extension rod under said spring being fitted in said outer rod, said extension rod having a position means at an upper end, said extension rod being able to move up and down in said outer rod and be locked at a plurality of positions by means of said position means so that the height of each said post may be adjusted according to necessity.

3. The multi-use collapsible sun-shade tent as claimed in claim 1, wherein said sun-shade cloth has a stop edge respectively formed in two ends so a to be stopped by a tubular support respectively fixed in said narrow groove of each said lateral beam.

* * * * *